US006011248A

United States Patent [19]

Dennis

[11] Patent Number: 6,011,248

[45] Date of Patent: Jan. 4, 2000

[54] METHOD AND APPARATUS FOR FABRICATION AND SINTERING COMPOSITE INSERTS

[76] Inventor: Mahlon Denton Dennis, 2020 Rankin Rd., Houston, Tex. 77073

[21] Appl. No.: 08/936,392

[22] Filed: Sep. 25, 1997

Related U.S. Application Data

[60] Division of application No. 08/730,222, Oct. 15, 1996, and a continuation-in-part of application No. 08/687,870, Jul. 26, 1996.

[51] Int. Cl.[7] ..... H05B 6/78

[52] U.S. Cl. ..... 219/700

[58] Field of Search ..... 219/700, 762

[56] References Cited

U.S. PATENT DOCUMENTS 4,760,228 7/1988 Kudo et al. ..... 218/700

*Primary Examiner*—Teresa J. Walberg
*Assistant Examiner*—Jeffrey Pwu
*Attorney, Agent, or Firm*—Gunn & Associates, P.C.

[57] ABSTRACT

The present disclosure is directed to the fabrication of a highly wear layer either directly upon an article or tool support structure or body, or as a wear resistant insert or element which is subsequently attached to the tool body. The wear material is formed by sintering particulate material using the absorption of microwave energy as a means of heating. The disclosure also encompasses post manufacture annealing, using heating by microwave radiation, of both highly wear resistant inserts and composite articles which consist of a wear resistant layer and a body. The wear resistant material, whether fabricated directly upon an article or fabricated separately and subsequently affixed to an article, provides an abrasive wear surface and greatly increases the life of the article. Microwave sintered wear resistant surfaces for mills, drills, grinders, brakes, bearings, saw blades and other articles and assemblies are disclosed.

29 Claims, 7 Drawing Sheets

FIG. 1
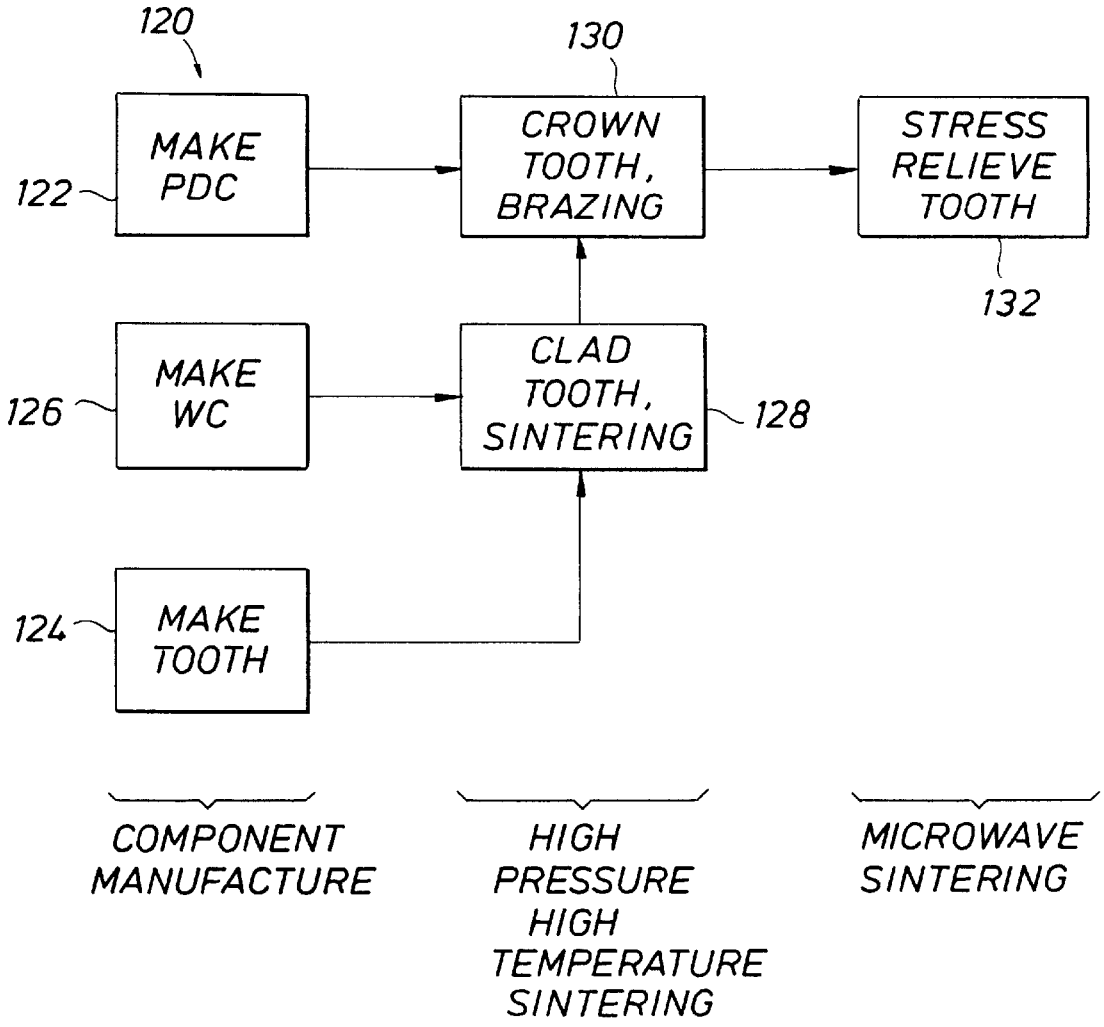
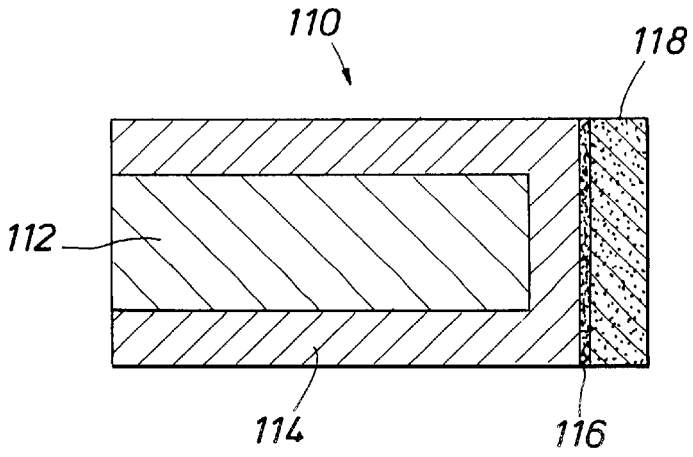
FIG. 2

FIG. 4A
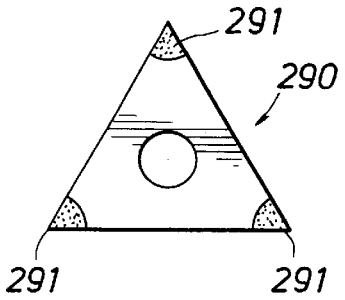
FIG. 5A
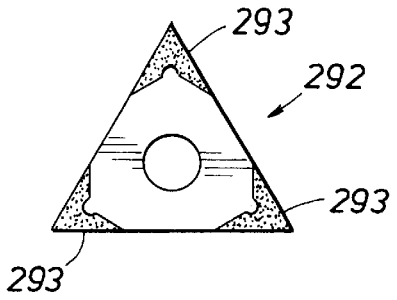
FIG. 4B
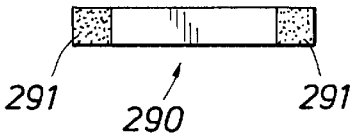
FIG. 5B
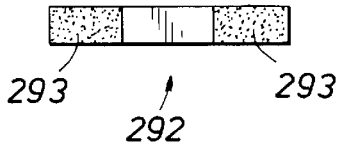
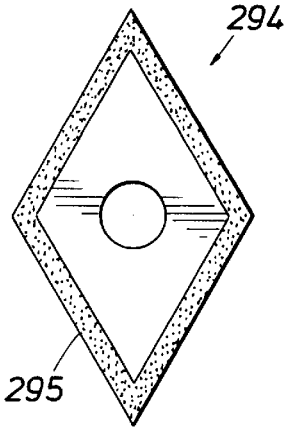
FIG. 6
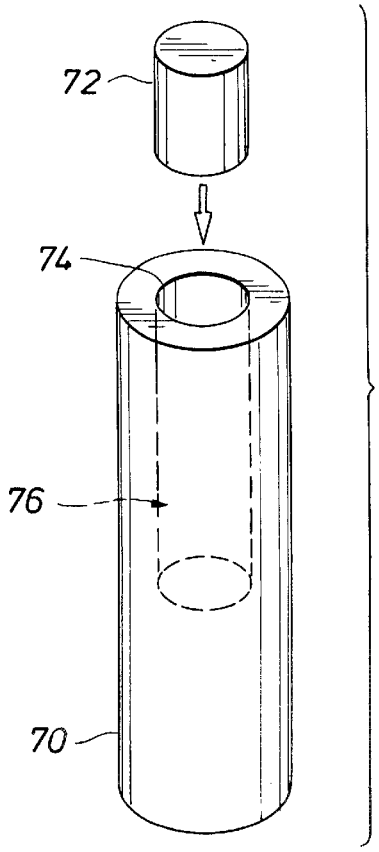
FIG. 7

FIG. 13a
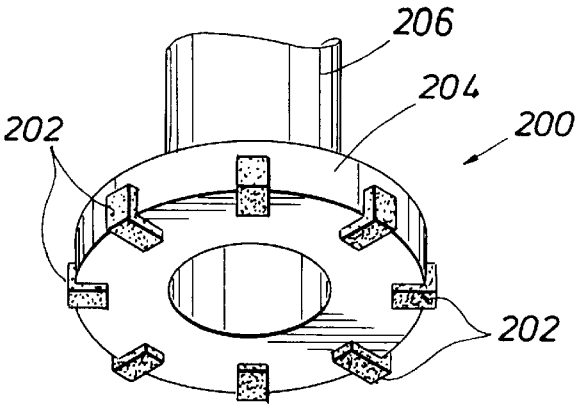
FIG. 13b
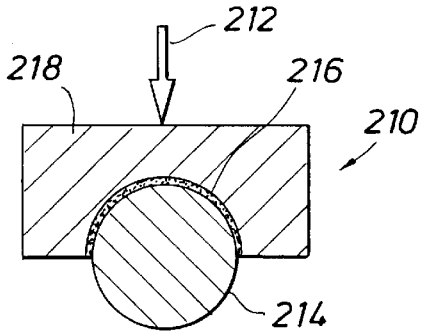
FIG. 13c
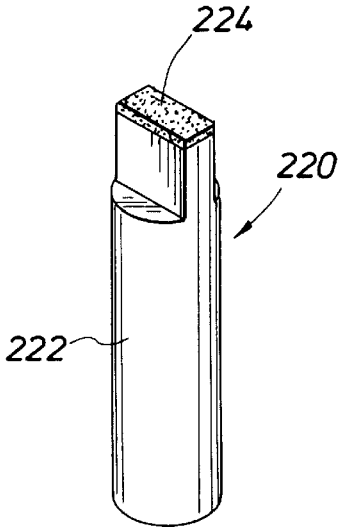
FIG. 13d
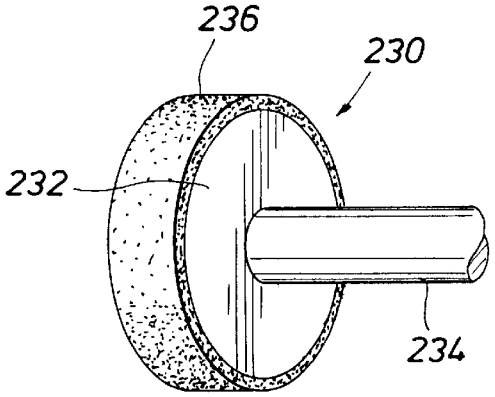
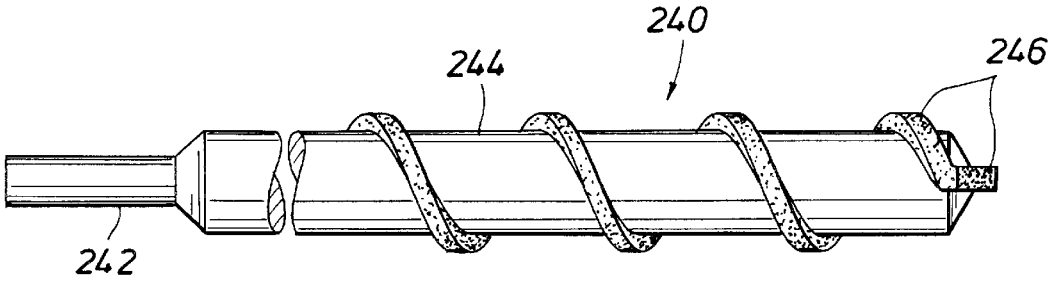
FIG. 13e FIG. 13f
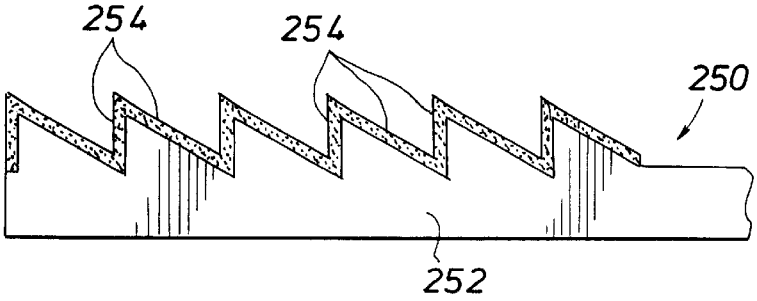
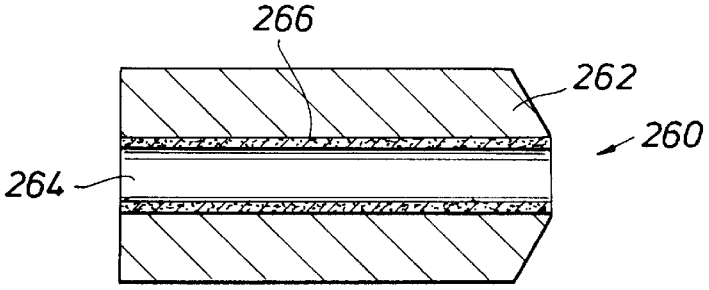
FIG. 13g
FIG. 13h
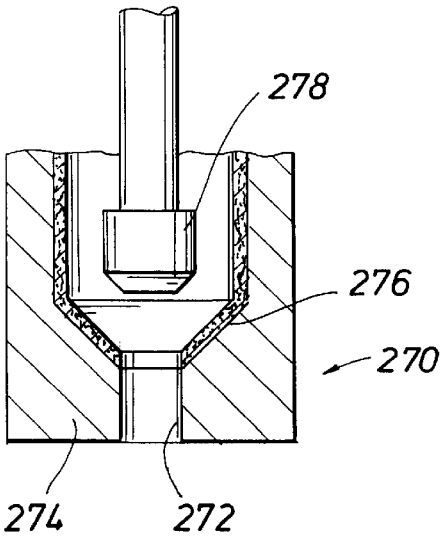
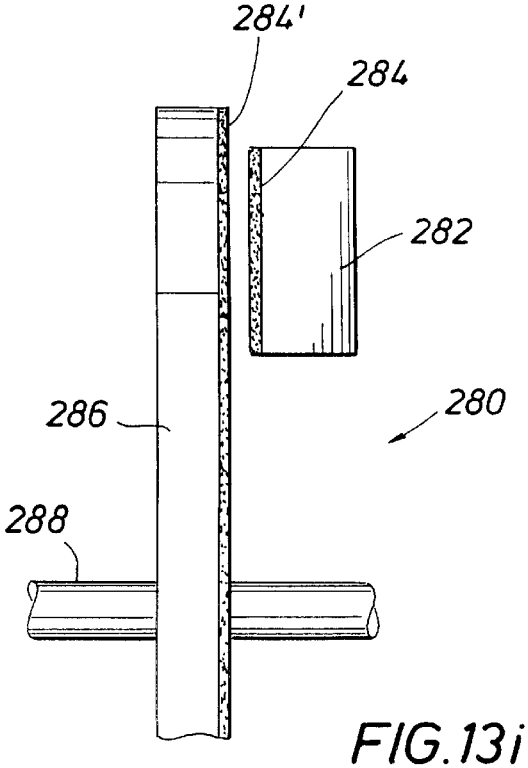
FIG. 13i

METHOD AND APPARATUS FOR FABRICATION AND SINTERING COMPOSITE INSERTS

This is a Divisional of U.S. patent application Ser. No. 08/730,222 filed Oct. 15, 1996, and is also a continuation-in-part of U.S. patent application Ser. No. 08/687,870 filed on Jul. 26, 1996.

BACKGROUND OF THE INVENTION

1. Field of the Invention

The present disclosure is directed to the manufacture of inserts, and more particularly directed toward the fabrication of highly wear resistant inserts using microwave sintering techniques, and the post manufacture annealing of highly wear resistant insert using heating by microwave radiation. Such inserts devices are typically installed in drill bits such as those used in drilling an oil well, or any other article which receives abrasive wear when used.

2. Background of the Invention

An oil well is drilled with a typical tricone drill bit, which is typically made of a threaded assembly which attaches to the bottom of a string of drill pipe. It has a hollow threaded member which threads to the drill pipe, and has axial flow passages which branch within the assembly to direct drilling fluid, usually known as drilling mud, out through a number of passage openings to wash cuttings away from the cones which provide the cutting. Rotation of drill string and attached drill bit is from the surface of the earth. Teeth on the drill bit are positioned against the face and bottom of the well borehole thereby cutting earth formation as the drill string and drill bit rotate, and thereby advancing the extent of the borehole into the earth. More specifically, the drill bit is preferably made of three cones mounted for contact against the face of the borehole. Each cone is positioned so that it can cooperatively rotate with the rotation of the threaded bit assembly and drill string, and thereby bring strong teeth against the face of the borehole wall as the borehole is advanced. Drill bit wear predominately occurs at the teeth. As the teeth wear, the drilling penetration rate, which is the linear extension of borehole per revolution of the bit, declines and the drill bit has to be replaced.

Cones and teeth made of hard metal have a specified wear rate. Better drill bit performance has been obtained by the optimizing the wear characteristics of the cone teeth, which are known as "inserts". The cone is therefore provided with a plurality of small holes and an insert is positioned within each hole. The inserts are harder than the metal body of the cone. Most inserts are formed with tungsten carbide (WC) which is an extremely hard material. Primary contact and wear between the insert and the earth formation being drilled occurs at the exposed outer end of the insert. Greater protection yet has been provided for this region. Such wear protection is obtained from industrial grade diamonds. The optimum wear protection appears to be obtained by the attachment of a cap or crown of industrial grade diamond which covers the exposed end of the insert. This type of crown is often known as a polycrystalline diamond compact (PDC). The WC insert body is not pure WC, but is preferably granules of WC which are interspersed with an alloy which binds the WC particles. The preferred alloy is a cobalt based alloy. Likewise, the PDC crown is not a layer of pure diamond, but is an agglomeration of diamond particles held together with a binding metal matrix. Again, this binding material is typically a cobalt based alloy. The PDC cap or crown is normally attached to the WC insert body by brazing. The brazing material may also contain a substantial amount of cobalt.

In prior art, elements of the insert are typically manufactured separately and subsequently assembled. The manufacture of the components is usually by sintering under very high temperature and very high pressure. This requires equipment which is physically large, and which is also very expensive to manufacture, maintain and operate. In addition, the high temperature can induce adverse chemical and physical changes in insert components, which will be discussed in subsequent sections of this disclosure.

As discussed in U.S. Pat. No. 5,011,515, composite polycrystalline diamond compacts, PDC, have been used for industrial applications including rock drilling and metal machining for many years. As an example, the composite compact consisting of PDC and sintered substrate are affixed as insert elements in a rock drill bit structure. One of the factors limiting the success of PDC is the strength of the bond between the polycrystalline diamond layer and a sintered metal carbide substrate. It is taught that both the PDC and the supporting sintered metal support substrate must be exposed to high pressure and high temperature, for a relatively long period of time, in order to achieve the desired hardness of the PDC surface and the desired strength in the bond between the PDC and the support substrate.

U.S. Pat. No. 3,745,623 (reissue U.S. Pat. No. 32,380) teaches the attachment of diamond to tungsten carbide support material with an abrupt transition there between. This, however, results in a cutting tool with a relatively low impact resistance. Due to the differences in the thermal expansion of diamond in the PDC layer and the binder metal used to cement the metal carbide substrate, there exists a shear stress in excess of 200,000 psi between these two layers. The force exerted by this stress must be overcome by the extremely thin layer of cobalt which is the common or preferred binding medium that holds the PDC layer to the metal carbide substrate. Because of the very high stress between the two layers which have a flat and relatively narrow transition zone, it is relatively easy for the compact to delaminate in this area upon impact. Additionally, it has been known that delamination can also occur on heating or other disturbances in addition to impact. In fact, parts have delaminated without any known provocation, most probably as a result of a defect within the interface or body of the PDC which initiates a crack and results in catastrophic failure.

One solution to the PDC-substrate binding problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep-through" of the metallic catalyst sintering agent is impeded by the free cobalt and the cobalt cemented carbide in the mixture. In addition, as in previous referenced methods and apparatus, high temperatures and high pressures are required for a relatively long time period in order to obtain the assembly disclosed in U.S. Pat. No. 4,604,106. Pressures and temperatures are such that, using mixtures specified, the adjacent diamond crystals are bonded together.

U.S. Pat. No. 4,784,023 teaches the grooving of polycrystalline diamond substrates but it does not teach the use of patterned substrates designed to uniformly reduce the stress between the polycrystalline diamond layer and the substrate support layer. In fact, this patent specifically mentions the use of undercut (or dovetail) portions of substrate ridges, which solution actually contributes to increased localized stress. Instead of reducing the stress between the polycrystalline diamond layer and the metallic substrate, this actually makes the situation much worse. This is because the larger volume of metal at the top of the ridge will expand and contract during temperature cycles to a greater extent than the polycrystalline diamond, causing the composite to fracture at the interface. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

By design, all of the cutting surfaces consisting of "conventional" alloys which are disclosed in the above references are "hard" in that they are abrasion and erosion resistant. This is particularly true for PDC material which is also quite brittle and subject to fracturing upon impact. Because of the brittleness and overall hardness, it is not practical and economical to machine surfaces of tools, bearings and the like made of PDC in the manufacturing process for these devices. Alternately, the PDC surfaces are preferably "molded" or performed using techniques taught in U.S. Pat. No. 4,662,896.

The paper "Iron Aluminum-Titanium Carbide Composites by Pressureless Melt Infiltration-Microstructure and Mechanical Properties" by R. Subramanian et al (*Scripta Materialia*, Vol. 35, No. 5, pp. 583–588, 1996, Elsevier Science Ltd.) discloses a technique for fabricating wear resistant material which does not require high pressure. Conversely, a mixture of powdered components is placed in a dynamic vacuum of 10–4 Pa, heated to a temperature of 1450 for about one hour. The binding component melts and flows into the interstitial voids of the wear resistant component. Vacuum equipment is obviously required to fabricate the wear resistant material.

U.S. patent application Ser. No. 08/517,814 which was filed on Aug. 22, 1995 and which is assigned to the assignee of the present disclosure and of which this application is a continuation-in-part, is entered herein by reference and discloses apparatus and methods for forming composite inserts at relatively low temperature and pressure. The composite insert can be assembled by brazing a separately sintered wear component to a support component, or by sintering the wear component directly onto the support component. The wear surface consists of a sintered mixture or "cermet" of crystalline material, metal and/or metallic carbides. These alloy materials are selected to minimize the sintering heat and temperature requirements. In a preferred embodiment, the wear surface material created by sintering consists of a mixture of abrasion resistant crystals, preferably diamond crystals, and a metal, which partially transforms to metal carbide, is a cemented diamond compact containing 60% or more diamond by volume, but lacking diamond to diamond bonding. Due to the high metal content and the short time of sintering, not all of the metal is reacted with the abrasion resistant material. The metal which is not reacted is then free to form a matrix in which the abrasion resistant material is suspended. This metal matrix is responsible for the enhanced ductility and fracture toughness of the material. The end result is a material with comparable abrasion and erosion properties to conventional, prior art materials, but the cermet is less costly to produce, has better impact resistance, and is more easily formed. A mold or cast is required to contain the wear resistant component during the low temperature cermet alloy during the low temperature and low pressure sintering operation. Disclosed means for heating are a simple torch, an induction oven, a source of infrared light, a laser source, a plasma, or a resistive heating oven. Attempts are made to use materials with matching thermal coefficients to minimize stress between the cermet and support components and stress within the cermet, although it is, still sometime preferable to anneal the final product.

U.S. patent application Ser. No. 08/687,870 filed on Jul. 26, 1996, of which this application is a continuation-in-part, discloses apparatus and methods for forming sintered components of alloys using microwave energy as a heat source, wherein the alloys are "conventional" in that they were previously used only in high temperature and high pressure sintering processes The insert body and the insert wear crown can be sintered as an integral insert within a mold, or can be sintered separately and subsequently joined by brazing as previously discussed. As an important additional advantage, the mold to contain the raw materials can even be completely eliminated by the use of a sacrificial binding agent such as wax prior to sintering. The microwave energy source permits the sintering process to be completed in a relatively short period of time, and at very low pressure. Temperature can also be controlled. If sintered as a unit, migration of cobalt within the various components is negligible due to the relatively short sintering time required. The disclosure also teaches that smaller grain sizes can be obtained without the use of grain growth inhibitor, which can adversely affect the insert in other ways. Stress concentration at the interface of insert components is still present, although markedly reduced if the insert is sintered as a unit. Stress concentration at the interface of components assembled after sintering can be significant.

There is a delicate balance to be obtained in the finished wear product between hardness and resiliency. If materials are harder, they are lacking in resilience, and if they are resilient, they are lacking in hardness. As discussed previously, composite materials such as a wear resistant crown and an insert body of differing material yield high quality inserts. However, the composite materials are all different and therefore have contradictory criteria meaning they have different measures of hardness, different resiliency, different rates of thermal expansion, and different measures of shock resistance. A representative insert will be described which utilizes a central steel shank or body. The body, in turn, is covered with the WC abrasive resistant material. Separately, a PDC crown is made at another location and then this PDC layer is brazed to the partly finished WC clad steel shank. Prior art manufacturing is typically by high pressure high and temperature sintering, sometimes known as "HPHT" sintering. While the finished product is quite successful, there are, however, problems that arise because of the dissimilarities in the various materials making up the finished device. In one aspect, the sintering process mandates that the components be made separately and later joined. This leads inevitably to transverse planar regions which localize possible stress failure. In a typical insert, the PDC crown is brazed by a braze region which measures only about 0.001 to about 0.004 inches thick. Moreover, this thin region of braze material must secure dissimilar materials together so that there are stress levels in this braze region which are detrimental to long life. Even if the stress is relatively minimal by careful manufacture, the drill bit is used in elevated temperatures so that stress concentrations can again build up which are not common at ambient temperatures. Regrettably, the failure mode of many inserts is fracture along the braze plane so that part or all of the PDC crown will break off.

This type of insert defies stress relieving by annealing using some prior art teachings. For instance, in the manufacture of glass and other relatively brittle materials, the finished product can be gently heated to a relatively high temperature for a long period of time and then gently cooled over a long time interval to obtain some internal stress relief. That is not so readily effective for composite drill bit inserts. There is a problem with migration of cobalt between differing elements or regions of the composite insert. Suffice it to say, the cobalt levels in different regions vary because different quantities of cobalt are required to provide the bonding matrix holding the various different particles together. The cobalt concentration in the PDC layer is different from the cobalt concentration in the braze layer, and is different from that in the WC sheath. Heating for a long interval at elevated temperature may enable the cobalt concentration to simply average out, thereby degrading the performance of the cobalt based alloy in one region or the other.

The heating phase of both sintering manufacturing methods and post manufacture annealing methods can also be detrimental to the different regions of the insert. As an example, the crystalline structure of carbon on the PDC can be adversely affected by physical changes at high temperatures, whether applied in the manufacturing step or the annealing step. This reduces the wear properties of the PDC. Above a certain temperature, the carbon will begin to oxidize or otherwise be affected chemically, thereby also significantly reducing the wear properties of the PDC. Therefore, it is necessary to maintain sintering and annealing temperatures below a threshold at which damage to the PDC is incurred. Using prior art teaching, this can be accomplished by longer sintering and annealing heating times but at lower temperatures. These longer heating periods, however, result the previously discussed cobalt migration problem which, contradictorily, is minimized by heating for a shorter period of time but at a higher temperature.

Sintering and annealing at elevated temperatures for long periods of time can be detrimental to the grain size of the wear surface which can, in turn, affect the resilience of the wear surface. The smaller the grain size, the more resistant the material is to chipping and fracturing. High sintering and annealing temperatures tend to increase the grain size of sintered material and thereby degrade wear properties.

The use of a mold to fabricate wear inserts or integral wear resistant parts can be very expensive, especially if relatively small numbers of pieces are to be fabricated. A mold or cast is required in the sintering of conventional alloys using high temperature-high pressure techniques, in microwave sintering of conventional alloys using methods and apparatus disclosed in previously referenced U.S. patent application Ser. No. 98/687,870, and in the sintering of low temperature alloys as disclosed in previously referenced U.S. patent application Ser. No. 08/517,814.

In summary, prior art teaches the manufacture and the use of various abrasion and erosion resistant materials to form inserts which are used as wear surfaces in drill bits, and which can also be used for wear surfaces on machine tools, drill bits, bearings, and other similar surfaces. Many of the processes in the cited references require high temperatures and high pressures to sinter conventional alloys for a relatively long period of time to form the wear resistant surface material, or to bond the wear resistant surface material to the underlying support substrate, or both. A mold or cast is required. Using a composite drill bit insert as an example, cobalt can migrate between wear surface, braze layer, and insert body thereby perturbing the desired concentration of cobalt in each element of the insert. Furthermore, the bond between surface and substrate of the resulting inserts is subject to weakening due to differences in thermal expansion properties which become a factor as the device heats up during use. This can be reduced by annealing, but annealing at high temperatures over long periods of time also results in cobalt migration as discussed in the example above. Sintering and annealing heating for extended periods of time can also cause grain size growth which yields a wear surface which is quite brittle, subject to fracturing upon impact, and are in general very difficult to handle in the manufacturing process of tools employing such wear resistant surfaces. Sintering and annealing at high temperature can also adversely affect the chemical and physical properties of the wear surface. As an example, a PDC wear surface will tend to oxidize if heated at elevated temperatures. To minimize elemental migration between regions, and to minimize grain growth, and to minimize damage to the wear surface, it is desirable to apply sintering and annealing heat at a relatively low temperature and for a relatively short period of time. Low pressure is also desirable from an economic and operational point of view. Low pressure and low temperature sintering of wear resistant components is taught in previously referenced U.S. patent application Ser. No. 08/517,814, but a low temperature allow and a mold or cast are required. Microwave sintering of conventional alloys without the use of a mold is taught in U.S. patent application Ser. No. 08/687,870. The fabrication of wear elements by means of low temperature-low pressure sintering of conventional and low temperature alloys, using microwave energy, without the use of a mold, is not disclosed in the prior art. Furthermore, prior art does not disclose the low temperature annealing of wear elements, which comprise conventional and low temperature alloys, using microwave radiation as a heat source.

An object of the invention is to provide apparatus and methods for sintering and stress relief using microwave energy.

Another object of the invention is to provide apparatus and methods for manufacturing sintered, composite wear inserts, wherein the sintering temperature is generated by microwave energy and is below a level which inflicts adverse physical and chemical changes in components of the composite insert.

Yet another object of the invention is to provide apparatus and methods for manufacturing sintered, composite wear inserts, wherein the heating cycle is relatively short thereby preventing elemental migration between various components of the composite insert.

Still another object of the invention is to provide apparatus and methods for manufacturing sintered, composite wear surfaces, wherein the magnitude and duration of the heating phase of the sintering operation is set to minimize grain size growth in components of the composite insert.

An additional object of the invention is to provide apparatus and methods for effectively annealing composite wear elements at relatively low temperatures and for relatively short periods of time using microwave energy, thereby reducing stress concentration at any component interfaces, minimizing the migration of constituents between the components, and inhibiting grain growth within the components.

A further object of the invention is to provide a means for annealing wear components which eliminates the need for expensive high temperature and high pressure equipment used in the present art.

A still further object of the invention is to provide apparatus and methods for fabricating wear elements of conventional and low temperature elements without the use of a cast or mold.

There are other objects and applications of the invention which will become apparent in the following disclosure.

SUMMARY OF THE INVENTION

The present disclosure is summarized as a method for manufacturing and for post-manufacture annealing composite wear inserts using microwave radiation as a heat source. Conventional or low temperature alloys can be used in the wear inserts, and a mold or cast is not required in the fabrication process.

3. Interaction of Microwave Radiation and Matter

As a precursor to summarizing the invention, the basic principles of interaction of microwave radiation with metal will be reviewed.

The modes of interaction between material and electromagnetic radiation in the microwave region can be defined as transparent, absorbent and reflective. The interaction is defined as transparent when the microwave radiation passes through the material with no attenuation. The interaction is described as absorbent when the microwave radiation is completely absorbed within the material. The interaction is described as reflective when the microwave radiation is reflected away from the material without attenuation.

The modes of interaction between microwave radiation and material is affected by the frequency of the radiation and the temperature of the material. Assume first that for a given material temperature, the mode of interaction is reflective. As the frequency of the radiation is changed to some threshold level, some of the microwave radiation will be absorbed by the material. As the frequency is further altered, more radiation will be absorbed. Eventually a frequency will be reached in which all radiation will be absorbed. If the frequency is still further changed, absorption will decrease and transparent will become a mode of interaction. When the frequency is changed beyond a second threshold level, the material will become completely transparent.

Assume again that for a given material, the mode of interaction is reflective. Further assume that the frequency of the microwave radiation is held constant. As the material is heated (presumably from an external source) above a threshold temperature level, the dielectric loss begins to increase rapidly and the material begins to absorb microwave radiation. The absorption also generates heat and rapidly increases the temperature of the material internally and independent of any external heat source. As the temperature of the material is increased further, absorption dominates the interaction mode and as the temperature is increased even further (presumably by means of an external heat source), absorption declines and reflection dominates.

In the remaining portions of this disclosure, it will be assumed that all microwave sintering and stress relieving processes begin at an ambient "room temperature".

4. Manufacture of Wear Resistant Parts

Turning first to the manufacture embodiment of the invention, microwave heating has demonstrated itself to be a powerful technique for sintering various ceramics, especially through the past decade. Microwave heating may decrease the sintering temperatures and times dramatically, and is economically advantageous due to considerable energy savings. However, one of the major limitations is the volume and/or size of the ceramic products that can be microwave sintered because an inhomogeneous microwave energy distribution inside the applicator which often results in a non-uniform heating. Considerable research has gone into making microwave sintering technology commercially viable, and as a means for solving some of the previously discussed technical problems encountered in the manufacture of composite wear resistant inserts. Results of this research will be disclosed in this disclosure.

This disclosure sets forth three different types of products of manufacture which can be handled by microwave heating to obtain sintering. The three different types of products refers to the form of the products, not the chemical makeup of the products. Indeed, the products can be made of the same constituent ingredients. They differ however primarily in the shape and hence the cohesive nature of the respective products. These three product formats or forms include loose particulate material such as (1) a powder of a specified size, (2) a molded product, or (3) a precast molded product. The distinction in the latter is that it is precast sufficiently that it requires no mold during sintering. It can be precast with a sacrificial wax, adhesive, moisture are even low pressure compaction of the material which forms the particles together into a desired precast form. During sintering, the form is not changed in terms of shape, but the form is sustained although this is accomplished free or devoid of a confining mold. The molded product is a product which is held in a mold during sintering. One of the advantageous aspects of the molded products is that initial mold shaping of the particles making up the product can be accomplished at very low temperatures and pressures, i.e., substantially at room temperature and atmospheric pressure. Typically, a set of particles are joined in a mold again by a sacrificial wax, other material, low pressure compaction or alternately by the confines of the cavity mold itself. In either instance, the finished product is a structure which is sintered and yet which has a defined shape or profile. Examples abound as will be set forth below.

In all instances, all examples will be described so that the sintering process begins or acts on what are known as "green" materials. The term "green" materials refers to those materials which have been provided but have not been sintered. These green materials consists of ingredients in the low temperature-low pressure alloys disclosed in previously referenced U.S. patent application Ser. No. 08/517,814 such as abrasion resistant particles and bonding material which wets and reacts with the abrasion resistant particles. In addition, the green materials can consist of conventional ingredients used in prior art high pressure-high temperature sintering techniques taught in the prior art. For particulate matter, the green materials typically have the form of powders. Both in the molded and precast forms, one of the beginning materials is the requisite quantity of particles prior to molding, i.e., shaping into a desired form either by precast molding or sintering in a mold.

The preparation of loose material which is sintered defines small particles which can be used later in a wear surface and the like. Normally, these materials must be sintered to a specified grain size. In many applications, the quality or performance of the material is directly impacted by the grain size accomplished in the sintering process. In one aspect, grain size has an undesirable impact on the finished product. More specifically, this arises from the fact that additives often are placed in control quantities in the material prior to sintering so that the grain boundaries are defined by the additives. While there are additives available which do control grain size, the additives weaken or reduce the hardness of the finished product. Therefore such additives, while desirable in one aspect, are not desirable in other regards. The amount, nature, and dispersal of such grain boundary additives is a material factor, thereby providing a balanced mix of properties where the properties themselves result in some kind of compromise in the design of such sintered products. Effectively, grain boundary size is controlled only at a cost in sintered particle hardness.

Continuous microwave sintering of powders such as alumina is newly developed. A microwave applicator is designed to focus the microwave radiation field in a central area as uniformly as possible. A long cylindrical ceramic hollow tube contains the unsintered (or green) material which is fed into the microwave applicator and into the central area at a constant feed speed. As the green material enters the microwave cavity, it is heated and gradually sintered while passing through the microwave zone. The heating rate, sintering time and cooling rate are controlled by the input microwave power, the feeding speed, and the thermal insulation surrounding the heated material. The ceramic hollow tube is also rotated during processing for uniform and homogeneous heating. As the green material passes through the high temperature zone, the particles are sintered entirely. Since the ceramic hollow tube is moved continuously in the axial direction during the processing, there is virtually no limitation to the length or volume of the product that can be processed by this technique. Consequently, it is possible to scale up the volume of the ceramic products to be microwave sintered by this technique by implementing a continuous process.

This disclosure proves the continuous microwave sintering manufacture technique for small or large quantities of green material to make a desired shape or volume of material. The results show better physical properties than the conventionally processed material. The disclosure sets out three different product configurations. One form is a loose, unconsolidated particulate product, a second comprises a cold press shaped or configured particulate body shaped by a mold at minimal pressure, and a third form is a cold pressed, unconfined form of sufficient strength to hold its own shape either with or without a sacrificial binding agent such as wax. The three products are generally referred to below as sintered particles, molded products and precast products.

In prior art devices, molds are typically used for sintered particles or for composite cast items (molded or precast) such as wear inserts for drill bits. A molded part can be sintered by placing green particulate materials in a mold or cavity in the desired geometric configuration. The mold is first filled with the appropriate, configured green constituent materials. As an example, tungsten carbide or silicon nitride particles are packed into a mold or cavity. An interspersed particulate binder metal, typically a cobalt alloy, is added in the mold or cavity. In the prior art, extreme heat with deleterious consequences was applied in the ordinary manufacturing process along with extremely high pressure to form a molded part. The resultant part is a matrix of hard particles which are held together by the melted alloy. The alloy serves as a binder which holds the shape of the finished part. By applying an adequately high pressure to the cavity and by also applying an adequately high temperature for a desired interval, molded parts were made in this fashion. Examples of such wear parts include in addition to the drill bit insert, nozzles for directing a flow or stream of fluid, deflector plates, scuff plates, twist drills, saw blades, milling tools, finishing tools and the like. The prior art high pressure and high temperature (HPHT) equipment is quite large, quite expensive to fabricate, and quite expensive to operate. Furthermore, high temperature and/or extended heating periods can be detrimental to the final product as discussed previously.

The microwave process of this disclosure does not require massive and expensive manufacturing equipment, thereby reducing cost and improving speed of fabrication. By contrast, such molded products can be made using the microwave sintering apparatus and method set forth in the present disclosure. The particulate materials are tamped into a cavity at a desired packing density and configuration without requiring any extremely high pressures. The cavity is formed in a tube of material which is transparent to microwave radiation. This transparent tube is then positioned in the microwave cavity of the sintering apparatus. Sintering occurs at a more rapid temperature increase, yet is consummated at a lower temperature level. The former feature minimizes migration of elements such as cobalt between regions or components of the article of manufacture. The latter feature reduces the possibility of high temperature induced physical or chemical damage to components of the device. Moreover, the grain size within the solid part of the device does not grow as great as normally occurs in a conventional sintering process. Improved hardness and chip resistance is obtained with a smaller grain structure in the molded part. The alloy sinters the entire particulate mass in the mold to thereby furnish a wear part. Examples of this will be given below.

The particulate or green material is shaped at room or ambient temperature in a mold, a preliminary process called "cold pressing". The tamped or pressed particles are shaped to the desired configuration by a low cost cavity or mold. If the particles are sufficiently self adhesive, the particles can be precast by low pressure compaction into the desired shape and then sintered. If crumbling of the precast occurs, a sacrificial adhesive material such as wax can mixed with the particles prior to precasting. During sintering, this sacrificial material is driven by heat from the precast. As an alternate to precasting, the green material can be formed in the low cost, microwave transparent mold can be exposed to the microwave field to sinter the mold contents.

By the use of the manufacture process of the present invention, it is possible to prepare a new variety of extra hard, shaped parts at considerably lower temperature with smaller grain size, higher hardness and density. The process of the present invention also uses microwave sintering to obtain higher heating rates to form better conventional products. It has been found that for the microwave frequency ranged used and at room temperature, green materials used in the manufacture of wear inserts and the like are primarily reflective but still somewhat absorptive of microwave radiation. When exposed to microwave radiation, this partial absorption results in an initial heating of the material which, in turn, increases the dielectric constant of the material which, in turn, further increases the absorptiveness of the material which, in turn, results in further heating of the material. This "bootstrap" heating process terminates when the temperature of the material is elevated to a value at which the material becomes completely absorptive. This concept will be discussed further, and is a major contributor to the higher heating rate of the microwave sintering process. Heating rates as high as 300° C./minute can be obtained. Furthermore, the desired sintering can be obtained at temperatures below which components are adversely physically and chemically altered. In the process of the invention, microwave heat is generated internally within the material instead of originating from external heating sources, and is a function of the material being processed.

As a rule of thumb, the performance of the particulates with the same hardness, toughness and density improves with decrease in grain size. It is possible to achieve very small grain sizes with high hardness, toughness and density, using the microwave processes thereby improving the characteristics when compared to the conventional process. This process requires much lower temperature (less than about 1350° C.) than conventional sintering techniques (around 1500° C.).

5. Post-Manufacture Annealing of Inserts

Microwave energy can be used in heating of post-manufacture of wear inserts to provide stress relief or carry out an annealing process. Essentially the same apparatus is used for annealing as is used for manufacture, with the exception that previously manufactured parts such as inserts are placed within the microwave cavity rather than green materials used in the manufacture of the parts. The annealing technique works equally well with inserts manufactured using the previously described microwave manufacture process, and with inserts made using other techniques such as high temperature and high pressure sintering methods in the prior art. Heating and cooling is provided for internal stress relief. Moreover, it is an approach which permits the finished insert to be relieved from internal stresses while yet preserving the strength of the device, the integrity of the cobalt based alloys in the finished product, the physical and chemical properties of the wear surface of the insert, and also protecting the grain size. Microwave radiation is used to heat the insert.

The present disclosure contemplates the conventional manufacture of an insert having a PDC crown attached at one end by brazing to a WC protected body. That finished product is (subsequent to manufacture) annealed using a microwave heating process so that the microwave annealing process relieves stress, preserves grain size, does not adversely affect the properties of the PDC crown, and does not destroy the differences in cobalt concentration.

Using apparatus previously described, the composite insert is placed within the microwave cavity and exposed to microwave radiation at preferably a set frequency. At this frequency and at room temperature, it has been found that the components of the insert are reflective to the microwave radiation. This is in contrast to green materials which have been found to be at least partially absorptive of the microwave radiation at room temperature. Heat from an external source is therefore applied to the insert until the temperature of the insert is increased above the threshold of partial absorption. At this temperature, the previously described bootstrap heating of the insert is initiated. That is, the dielectric constant of the insert begins to increase rapidly, resulting in a rapid increase in absorption of microwave energy, which in turn results in the rapid heating of the composite insert. The desired annealing temperature is rapidly reached once the insert becomes absorptive. Using this methodology, heating rates are as high as 300° Centigrade (C) per minute are obtained, thereby allowing a desired annealing temperature of perhaps 1200° C. to be reached in only four minutes, at which time cooling can begin. Migration of alloys such as cobalt is negligible during these time intervals as will be discussed subsequently. Furthermore, grain size growth is held to a minimum. Finally, exposing the insert to the maximum annealing temperature for such a short period of time caused no damage, such as oxidation, to the PDC crown.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a block diagram flow chart showing a method of manufacture which involves microwave annealing to thereby permit the stress relief of a multicomponent or composite insert;

FIG. 2 is a sectional view through a typical insert showing different regions of material in a composite insert

FIG. 4 shows a microwave sintered alumina grit in a microphotograph;

FIGS. 5 and 6 show different microwave sintered grit processed with different conditions;

FIG. 7 shows a mold or cavity in a tube;

FIG. 13*a* shows a milling tool which incorporates a plurality of wear resistant inserts;

FIG. 13*b* illustrates an example of a bearing which utilizes a wear resistant surface fabricated;

FIG. 13*c* depicts a dressing tool 220 to which is affixed a wear resistant dressing surface;

FIG. 13*d* illustrates a grinding wheel which incorporates a wear resistant grinding surface;

FIG. 13*e* illustrates a drill which incorporates a wear resistant surface;

FIG. 13*f* shows a saw blade to which is affixed wear resistant elements at the point of contact with the work piece;

FIG. 13*g* depicts a cross section of a nozzle which utilizes a wear resistant insert to minimize wear by abrasive fluids;

FIG. 13*h* shows a cross sectional view of a valve wherein the seat of the valve incorporates a wear resistant element to minimize wear from abrasive fluids;

FIG. 13*i* is a sectional view of a brake assembly which utilized wear resistant contact surfaces; and

DETAILED DESCRIPTION OF A PREFERRED EMBODIMENTS

Figure 3:
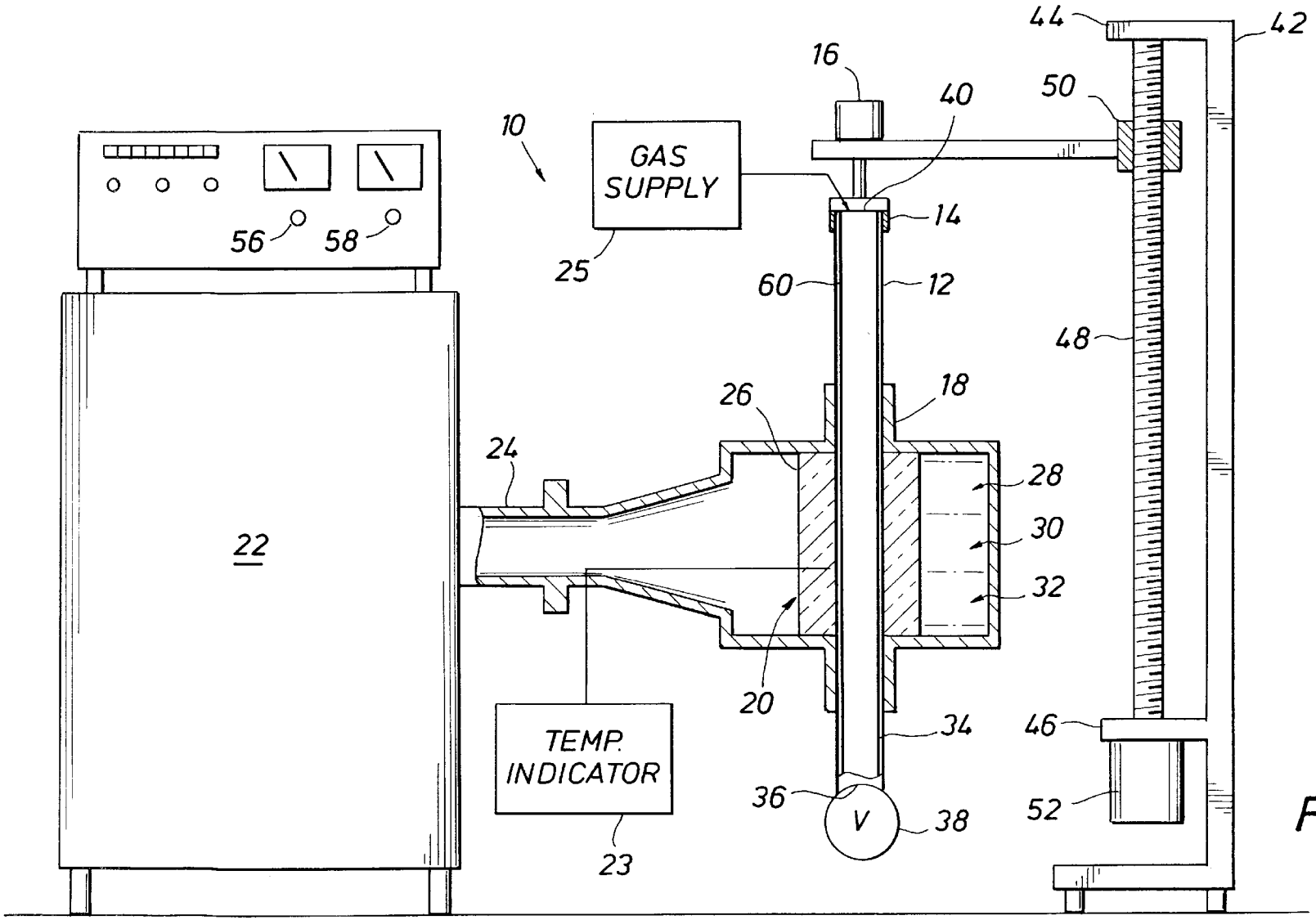
FIG. 3 is a system drawing of a microwave oven arrangement for reduced temperature sintering.

FIG. 1 of the drawings shows as a simplified operational diagram consisting of both manufacturing steps in making an insert and a post-manufacture annealing step. For purposes of discussion, it will be assumed that the manufactured wear insert consists of three components which are a steel shank or "tooth", a tungsten carbide (WC) sheath about the tooth, and a PDC wear resistant crown affixed to the WC sheath. The tooth is fabricated at operation 124. The WC is prepared and possibly sintered to the desired grain size at step 126. The WC is then applied to the exterior of the toot at step 128. A PDC crown is made at step 122 which possibly includes sintering to the desired grain size. The PDC crown is then affixed, preferably by brazing, to the WC clad tooth at step 130. This results in a manufactured wear insert. It should be mentioned that the insert method can be made in a variety of ways including the HPHT methodology of the prior art or the composite microwave sintering methodology taught in the present disclosure. Post-manufacture annealing is accomplished at step 132.

Attention is now directed to FIG. 2 which shows a cross sectional view of the manufactured wear insert tooth identified as a whole by the numeral 110. The WC layer 118 is applied to the exterior of the preferably steel insert or "tooth" body 112 to provide a surface covering over the entire surface of this steel member. The WC protective layer 114 is formed of two major components comprising powdered WC and a binder. WC particles are held together in the binding matrix. The WC particles, which are extremely hard, are mixed with an adhesive and an adherent alloy which is melted thereby forming a binding material. The irregularly shaped WC particles are held together with the alloy matrix so that the particles are packed around the steel shank 112 and adhere to it. In this regard, the alloy is a binding agent so that the particles are held together and are held to the insert body 112. FIG. 2 shows a braze layer 116 which is used to attach the PDC crown 118 to the wear primary WC surface.

Still referring to FIG. 2, all three regions of materials 114, 116 and 118 incorporate cobalt at different concentrations. As a practical matter, the PDC and WC layers include hard particles which make up the bulk of those two portions. In other words, the alloy may constitute only about 5% to about 20% of those two regions. The braze alloy, however, makes up 100% of the braze layer 116. In these three regions, the amount of cobalt in the supportive metal alloy matrix is different, and because it is different, such differences impose a process limitation as will be explained on annealing.

It should be understood that there is flexibility in the methods used to fabricate composite wear resistant elements. As an example, the protective layer 114 can be fabricated using a variety of techniques such as conventional HPHT techniques, or low pressure and low temperature techniques as disclosed in previously referenced copending application Ser. No. 08/517,814. The layer 118 is fabricated by means of microwave sintering and preferably brazed using microwave radiation as a heat source. The material used for the protective layer 114 can be either conventional alloy or low temperature and low pressure sintering alloy as discloses in copending application Ser. No. 08/517,814. "Conventional" alloys, as referred to throughout this disclosure, usually contain hard, abrasive resistant crystals and a relatively high concentration of cobalt as will be discussed below. "Low temperature" alloys, as referred to throughout this disclosure and as disclosed in application Ser. No. 08/517,814, include abrasion resistant particles, bonding material which wets and reacts with the abrasion resistant particles, and a contiguous, solid matrix material in which the reacted particles of abrasion resistant materials are suspended and bonded. The contiguous matrix material preferably consists essentially of a metal such as titanium or zirconium carbide, boride, or nitride. The bonding material preferably consists essentially of metallic carbide, boride, or nitride, or alternately, consists essentially of titanium or zirconium carbide, boride, or nitride. The matrix material preferably consists of titanium or zirconium or alloys thereof.

6. Manufacture of Wear Inserts

Going over the apparatus in FIG. 3 in some detail, a microwave system 10 incorporates a microwave generator 22 which forms the microwave radiation at some extremely high frequency which is conveyed by a wave guide 24 to the microwave cavity. The cavity is defined on the interior of an insulative sleeve 26. The microwave cavity communicates to the central area 20. In the central area 20, the material is heated in a first zone 28 and reaches the maximum or sintering temperature in an intermediate zone 30. Zone 30 is contiguous with the zone 28. Recall that it has been found that for the microwave frequency used and at room temperature, the green material is somewhat absorptive when it enters the microwave radiation, and becomes more absorptive and therefore hotter until it reaches the sintering temperature in the zone 30.

FIG. 3 is configured to sinter a continuous supply of green material product (not shown). Configuration of the device to sinter composite parts will be discussed in detail in a subsequent section. The sleeve 26 prevents heat loss through the tube 12 as will be explained. As the product moves downwardly, it enters into the zone 32 where cooling begins. There is a discharge zone 34 at the lower end. The sintered material is delivered through the lower end 36. For the sake of controlling the flow rate, a valve 38 is affixed at the lower end to meter the delivered product. At the upper end, the tube is open at the top end 40 and the green ingredients are introduced through the upper end. The collar or clamp 14 fastens on the exterior and preferably leaves the top end 40 open for material to be added. The clamp 14 holds the tube 12 for rotation when driven by the motor 16. An adjacent upstanding frame 42 supports a protruding bracket 44 aligned with a bottom bracket 46. The brackets 44 and 46 hold a rotating screw 48 which serves as a feed screw. A movable carriage 50 travels up and down as driven by the screw. The screw 48 is rotated by the feed motor 52 shown at the lower end of the equipment. Rotation in one direction or the other causes the carriage 50 to move up or down as the case may be.

The microwave system shown in FIG. 3 is provided with an adjustable power control 56 and a timer 58. The timer is used in batch fabrication while the system 10 is normally simply switched on for continuous sintering. Attention is momentarily diverted to one aspect of the tube 12. It preferably is a dual tube construction with a tube 60 fitting snugly inside the outer tube 12. This defines an internal cavity through which the porous particulate alumina is added at the top 40. It flows along the tube at a rate determined by the rate at which the valve 38 is operated so that the material is maintained in the hottest zone 30 for a controlled interval. For instance, the rate of flow down through the tube can be increased or decreased by throttling the flow through the valve 38. This assures that the material remains in the hottest portion 30 of the microwave cavity. By rotating the tube continuously within the central area 20 of the microwave cavity and continuing a feed through the tube 12 which causes gradual downward linear motion, the particles are processed as appropriate by microwave sintering. By rotating without feeding the tube 12 through the cavity, but with controlled particulate flow through the tube 12 and valve 38, continuous sintering of a controlled flow can be done.

The microwave generator 22 employed produces microwave energy of preferably 2.45 GHz frequency but can be effectively operated in the range of 1.5 GHz to 4 GHz. Power delivered to the microwave cavity is normally within the range of 10 to 50 Watts per cubic inch of heated space, with a preferred power output of 30 Watts per cubic inch of heated space. In an alternate embodiment (not shown), the generator contains an additional frequency adjustment whereby the output frequency can be adjusted thereby controlling when the material within the microwave cavity becomes reflective, absorbent, and transparent. The particulate material is placed in the closed insulating microwave cavity. The insulating material is an aluminum silicate based material. An inner sleeve 60 of porous zirconia is also included. The system reduces heat loss from the cavity while maintaining high temperatures. A sheathed thermocouple, denoted conceptually by the element 23, is introduced for temperature measurement, and placed in the zone 30. This microwave system as configured in FIG. 3 provides batch or continuous processing of green material such as alumina abrasive grains. FIG. 3 shows a gas supply 25 which can optionally flood the regions of heated material and force oxygen out. Stated another way, the material is exposed to microwave radiation in a controlled atmosphere. This may reduce the risk of oxidation of sintered material.

As mentioned previously, the device shown in FIG. 3 is configured for sintering loose green particulate material and is used to illustrate basic concepts of the invention, and should not be construed to limit the scope of this present invention. Several examples relate to processing loose particles, cold pressed particles in a mold, and cold pressed particles holding a shape without regard to shape and free of a mold.

6.1 Microwave Sintering Setup for Particle Processing

Green particle material supplied by Carborundum Universal Ltd., India will be used in an example of continuous sintering of particulate material. The material consists of sol-gel derived alumina grit with average particle size of about 0.6 to about 1 mm. This green grit is first dried at 90° C. for 24 hours in an electrical dryer, and is then packed into a high purity alumina tube 12, which is about 30 millimeters (mm) in diameter and 900 mm in length, and which is held by a metal clamp 14 and connected to the shaft of the rotating motor 16. The tube 12 is inserted into the microwave applicator 18 with a middle portion located in the central area 20 of the cavity. At the beginning, the tube is stationary in the original position and is held while rotating only, without vertical feeding movement. It has been found that at a microwave frequency of 2.45 GHz, the unsintered material is at least partially absorptive of microwave radiation at room temperature. The previously described heating cycle is, therefore, initiated. Microwave power is introduced to the applicator 18 and controlled to achieve a heating rate of 50° C./min. When the sample temperature reaches the set temperature, the feeding motor 22 is started to feed the tube at the desired speed (about 2 mm per min.). The temperature of the sample is monitored by an infrared (IR) pyrometer (Accufiber Inc.), and is controlled by adjusting the incident microwave power. Sintering temperature and time can be varied from 1350° C. to 1500° C. and 5 to 45 minutes respectively. Parallel experiments from conventional furnace are reported to compare the results of the two processes.

The morphology and microstructure of the samples were characterized by scanning electronic microscope (SEM), the densities of the sintered samples were measured by the Archimedes method, and the Vickers hardness was measured by Micro indentation method. The grit morphology of the starting (a) and sintered (b) particles is shown in FIG. 4. The shape of the particles did not change, but the average particle size of the sintered sample decreased about one third because of the shrinkage during the sintering. It was expected that the particles would bind together tightly after the sintering. However, the results showed that there was no or very weak bonding between the particles. The particles sintered at 1500° C. can be very easily separated by hand. This is important as it makes it possible to feed the green particles into the alumina tube continuously with the automatic feeder during the microwave sintering. Thus, processing of large amounts for commercial production can be achieved.

FIGS. 5 and 6 show the micro structures of the samples processed under different sintering conditions with microwave and conventionally heating sources. Referring first to FIG. 5, the starting particles (a) are the agglomerates of very fine particles with average grain size of 50–100 mm. The sintered samples show an obvious grain growth. The grain size of the particles (b) grew up to about 0.2 mm after being sintered at 1400° C., and the grain size of the particles (c) grew further up to about 1.0 m at 1500° C. There are some pores in the sample (b) sintered at 1400° C. These pores disappeared in the sample (c) at the higher sintering temperature of 1500° C. The density of the samples increased at the same time. Conventionally sintered samples, shown in FIG. 6, under the identical conditions of 1400° C. (a) and 1500° C. (b) also show similar microstructure but with much higher porosity.

The quality of the microwave sintered particles mainly depends on the sintering temperature and time. During the continuous microwave sintering processing, the temperature is controlled by microwave power, and the sintering time, which is actually the residence time of the samples in the high temperature zone. The uniform high temperature zone is about 30 mm long in the microwave applicator. In this case, the residence time of the sample in the high temperature zone was about 15 minutes at a feeding speed of 2 mm/min.

Table 1 lists properties of sintered particles processed by conventional method and in the microwave field. The density of the samples increased with the longer sintering time or higher sintering temperature during the microwave sintering, but the conventionally sintered samples did not exhibit any substantial change in the density after processing above 1400° C. It is also noted from these results that higher abrasive index and hardness values were obtained in microwave sintered samples.

TABLE 1

| | Sample No. | Sintering conditions | Microwave | Conventional |
|---|---|---|---|---|
| | VI | 1450° C. × 15 min. | 3.70 | 3.92 |
| | VIII | 1406° C. × 45 min. | 3.94 | 3.96 |
| | X | 1500° C. × 15 min. | 3.96 | 3.89 |
| Abrasion Index | VI | | 95 | 68 |
| | VIII | | 100 | 65 |
| | X | | 94 | 94 |
| Micro Vicker's | VI | | 2205 | 732 |
| Hardness | VIII | | 2387 | 1026 |
| ($Kg/mm^2$) | X | | 2316 | 1885 |

6.2 Molded Part Manufacturing

The apparatus shown in FIG. 3 has been described above as processing particulate green material which is input to the hollow tube thereby enabling the manufacture of sintered particles. In many instances, that satisfies the requirements of the sintering procedure. In this aspect, the sintering equipment is used to manufacture a molded or cast member. This is a product which has been made heretofore in the prior art typically by high pressure, high temperature (HPHT) fabrication in a mold installed in a high pressure press. This uses two mold parts (male and female) which are brought together to define a mold cavity. The cavity is packed with particulate material including desired portions of selected carbides, nitrides or other hard particles and they are heated in the presence of a metal alloy which melts, thereby forming the requisite shaped or finished wear part. In the past, the mold had to be a heavy duty mold filled with the particulate green material and installed in a hydraulic press which applies very high pressures. Using the novel approach of the present invention, such pressures are not required and therefore the expensive hydraulic press and mold are not needed. Accordingly, part of the present disclosure sets forth a method of manufacturing what might be termed cast or molded composite wear parts using a microwave sintering technique.

Attention is directed to FIG. 7 of the drawings which shows a replacement for the hollow tube shown in FIG. 3, and more particularly, a tube like construction is preferred to enable the tube to travel in linear fashion through central area 20 of the microwave cavity as previously discussed. It is mounted in the same equipment as shown in FIG. 1, and is preferably advanced in a linear fashion. Rotation again is imparted by the motor 16. This distributes microwave heating more uniformly through the molded part. The valve 36 is not used in this application. FIG. 7, therefore, illustrates a simple mold cavity in an elongate ceramic rod which can be divided into two parts so that it can be filled, thereby obtaining a cast or molded part. The shape of the finished part will be the same shape as the cavity.

The mold in FIG. 7 shows a simple mold which can be used for casting a tooth or wear insert for drill bits. The finished product is an elongate cylindrical body as illustrated as the tooth 110 in FIG. 2. A solid ceramic tube 70 contains an axial passage 74. A plug 72 has a diameter to fit snugly in the axial passage 74. There is a cavity region at 76 shown in dotted line in FIG. 7. That region is the cavity in which the cast tooth or insert is made. Particulate material for the cast or molded tooth is put into the cavity 76 in the geometry required for the finished product. The plug 72 is fitted in the passage 74. Pressure is applied to pack down the material. While pressure is applied, the pressure that is necessary for this degree of packing is at least several orders of magnitude less than the pressures that are presently sustained in the manufacturing of such extra hard wear parts. The conventional HPHT manufacturing technique requires a hydraulic press with pressures of up to one million pounds per square inch (psi). In this instance, the pressure need only be sufficient to pack and force the material into a defined shape. The plug 72 is therefore pushed against the particulate material in the cavity 76. This defines the cast cylindrical part and the part when finished will have the shape of the cavity 76. For ease of extraction, it may be desirable to split the cylindrical body 70. In an alternative aspect, other shapes can be cast in the mold which may be formed of two or more pieces depending on the shape and complexity of the molded part. Furthermore, the material can be precast with a sacrificial material such as wax or other materials prior to insertion for microwave heating. If sufficiently self adhesive, the particles can be precast by simple compaction at low pressure. Precasts are supported in the central area 20 for sintering by means of any convenient microwave transparent structure such as a net made of microwave transparent material. What is desired in this particular instance is that the conformed shape of the hard part is achieved by the mold, and that the cavity within the mold, as a preliminary step, be filled with the desired material.

To make such a wear part, the particulate material that is placed in the cavity is typically and conventionally a hard metal carbide, nitride or other particulate material having extreme hardness. Tungsten carbide (WC) is the most common of these material although others are also known. In addition to that, a matrix of a cobalt based alloy is added. The other alloy components depend on the specifics of the requirements. Typically, the alloy is about 80 to 96% cobalt. The preferred alloy material is mixed in particulate form with the hard particles. When sintered, the particulate alloy will melt and seep into all the cervices and pores among the particles in the cavity and thereby form a binding matrix. The finished product will then have particles of extreme hardness held together in the alloy matrix.

In one aspect of the finished product, the alloy holds the particles together and this is especially true for both metal and ceramic particles. The term "cermet" has been applied to a mixed combination of materials including those made of ceramics and metals. The present procedure can be used to make a metal insert or other wear piece, and is also successful in casting cermets. Whatever the case, the rod-like mold shown in FIG. 7 in inserted into the cavity in the fashion shown in FIG. 3. It is passed through the microwave central cavity area 20 in a linear fashion if necessary. Optionally, rotation is applied to more evenly distribute the microwave radiation for even sintering. This enables sintering in a manner which provides improved characteristics for the finished product. This is one of the benefits of microwave sintering.

6.2.1 Improved Grain Structure

One aspect of the apparatus of the present disclosure is the modification of the grain structure of the finished product. After sintering, the grain structure is quite different from that obtained from conventional heating procedures. As a generalization, cast parts are formed by application of very high pressure and temperature for a long interval. As a generalization, the grain structure tends to grow. To stop this, inhibitors are added. A desirable grain structure in accordance with the teachings of the present disclosure however contemplates grains which are under 1.0 micron in size without growth inhibitors. Even smaller grain structures such as 0.1 micron dimensions can be achieved through the use of the present disclosure. The subject invention therefore provides a greater reduction in grain size and the micro structure as observed by various investigation instruments, such as a SEM, is enhanced by reduction of grain size without the use of the required inhibitors restraining growth.

Common growth inhibitors include vanadium or chromium, or compounds involving these. When added, they do limit grain growth during sintering, but they also have undesirable side effects. They alter the physical characteristics of the finished product. In some regards, another grain growth inhibitor is obtained by adding titanium carbide (TiC) or tantalum carbide (TaC). The addition of either of these two compounds causes undesirable side effects as evidenced by a change in physical characteristics.

Trace additions of vanadium or chromium are particularly detrimental where the cast or molded part is to be subsequently joined to a polycrystalline diamond compact. They are typically joined to a tungsten carbide insert body for use in drill bits. The PDC is adhered in the form of a cap or crown on the end of the tungsten carbide based body. The tungsten carbide insert body is joined by brazing or other heating processes to the PDC crown. In doing that, the heating process tends to draw vanadium and chromium into the region of the PDC bond. The vanadium and chromium additives which otherwise inhibit grain growth have a detrimental impact on the PDC crown which is later adhered to the insert body, i.e., by brazing or otherwise. It is therefore highly undesirable to incorporate such grain growth inhibitors.

Through the use of the present disclosure, a smaller grain can be achieved without addition of vanadium or chromium. This enables the fabrication of a substantially pure insert body (by that, meaning that it has no vanadium or chromium or other PDC poisons in it), thereby enabling an enhanced construction of a PDC crown insert body. The present disclosure therefore provides an insert body which can be subsequently joined to the PDC crown.

6.2.2 Reduced Cobalt Diffusion

Figure 8:
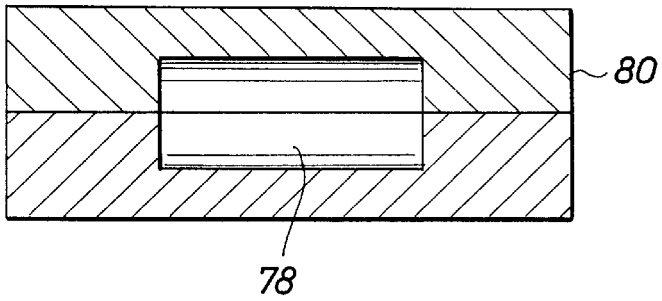
FIGS. 8 and 9 show views of a two-piece mold.
Figure 9:
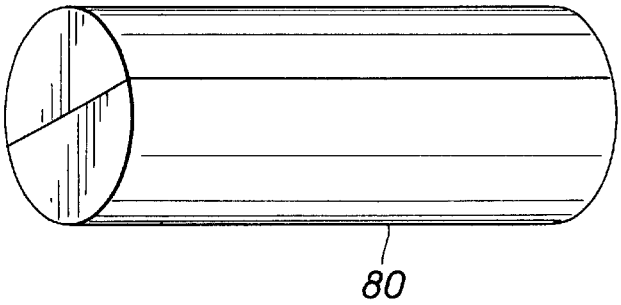

Attention is first directed to FIGS. 8 and 9 where a mold cavity 78 is shown in a two-piece mold 80. Conveniently, the mold 80 is in the form of the rod shown in FIG. 9 This enables the rod 80 to be advanced through the microwave chamber shown in FIG. 3 for sintering. As will be understood, the rod 80 can be of any length and therefore it can hold one or more such cavities. It is shown comprised of two mold pieces which divide and separate. This enables the cavity to be filled. It is filled with particles which can be loosely packed in the cavity. It is not necessary that the mold pieces divide precisely on the diameter of the rod 80. Therefore the cavity can be exposed for easy filling in this approach, or filling in the fashion shown in FIG. 7. It will be understood that there are many techniques for filling mold cavities with particulate material prior to microwave sintering to form the finished product. As an example, the particulate material can even be precast as discussed above and simply conveyed by the rod while being supported internally by microwave transparent structure. In any event, the rod 80 functions as a mold cavity and is constructed so that it progresses through the equipment shown in FIG. 3. This typically involved rotation of the rod 80 to distribute the microwave energy substantially evenly through the parts being made in the cavity. Again, the rod is also moved in a linear fashion through the equipment so that a specific dwell time in the microwave energy field is obtained. The rod 80 may have one or several cavities in it. If many, the rod is moved in the illustrated fashion through the equipment so that all of the cavities are exposed for full sintering.

Figure 10:
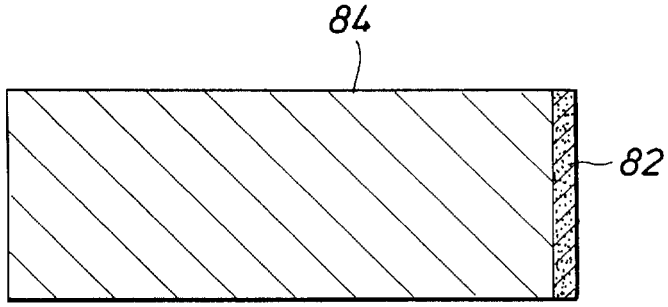
FIG. 10 is a sectional view through a sintered wear part having an extra-hard PDC layer at one end and a WC body.

Going now to FIG. 10 of the drawings, a simple cylindrical composite tooth or insert is shown. In this particular instance, it is provided with a PDC layer 82 adjacent to a WC body 84. The PDC layer is formed of small industrial grade bits of diamonds which are mixed with a binder. The binder is a cobalt based alloy and is mostly cobalt. The WC body is likewise a set of WC particles which are held together in a cobalt alloy. The two components are each provided with different concentrations or amounts of cobalt. The binding alloy itself is typically in the range of 80% to about 95% cobalt; there is however a difference in the amount of cobalt alloy material in the two regions. FIG. 10 shows the PDC layer 82 as a definitive covering which has a sharply defined interface. In the past, that has been an inherent aspect of manufacture of these two components in separate procedures where they are then joined by brazing. This definitive interface has been the source of problems. On the one hand, it is desirable to have such a sharply defined interface in that the cobalt concentrations have to be different on the two sides of the interface. It has been detrimental on the other hand in that the joiner of the two materials creates stresses which remain after cooling. Even worse, the two regions have different thermal expansion rates. That sometimes creates even greater internal stresses dependent on the ambient temperature of the device. Suffice it to say, this sharply defined interface that has prevailed in the past was a direct result of manufacture of the PDC layer 82 separate and remote from the WC body 84 and thereafter joining the two at the sharply defined interface. By using the approach taught herein, the particles for the diamond layer 82 along with the binding cobalt alloy necessary to hold it together are placed in the mold, and the particles for the WC body are also placed in the mold. The interface is not as sharply defined and it can be irregular in that the particles are irregular in shape and packing. Conveniently, the particles can be held together with a volatile wax which is driven off by heating. This serves as a simple sacrificial binder which is completely ejected from the mold cavity during heating. Indeed, the mold pieces need not join so tightly that they define an air tight chamber. Thus the binding wax can be readily applied to the loose particles to hold them ever so slightly prior to placing the particles in the cavity. With or without a binding wax, the particles are placed in the mold cavity and are subsequently sintered. The finished product is shown in FIG. 10 and comprises the PDC layer 82 which is sintered simultaneously with the WC body 84 so that the two are joined together. The bond between the two is sufficient to hold the PDC crown on the insert body so that it does not readily break or separate. Stress concentration at the interface is markedly reduced.

Figure 11:
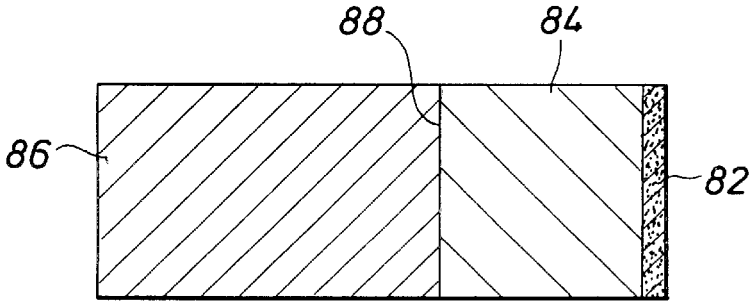
FIG. 11 is a similar wear part as that shown in FIG. 8 which is formed with multiple layers.

Going now to FIG. 11 of the drawings, an alternate form of the insert is shown. Again, the PDC crown 82 is joined to the WC body 84. The body 84 is shorter than that shown in FIG. 10 and the remainder of the body is formed of WC material 86 having different structural characteristics. This can be obtained by changing the concentration of the WC, change of grain size, and other factors. In this particular instance, a braze layer 88 is located in the assembled insert. The braze layer 88 defines a joint between the layers 84 and 86. In FIG. 11, there are therefore four different layers and each will have a different concentration of cobalt. The concentrations of cobalt can range from 90% or 95% at a maximum in the braze joint. While it is thin, it is sandwiched between two materials which are also made with a binding cobalt alloy but it is present in markedly reduced concentrations. Thus, the layer 88 might be a few mills thick flanked on both sides by quite thick layers of WC based material where cobalt is present in concentrations of 6% and 18% as exemplary values. Through the microwave sintering process, the relative cobalt concentrations are maintained without the cobalt diffusing over the long time interval otherwise involved in conventional sintering. Shorten time intervals are possible because of the partially absorptive nature of the green materials used in the microwave sintering process. This shorten sintering time preserves the value of the cobalt bonding material and the different regions.

6.2.3 Reduced Sintering Temperature

As discussed previously, the sintering temperature can adversely affect the physical and chemical properties of the sintered material, and this is particularly true of the wear layer such as the PDC layer. Excessive sintering temperature can perturb the crystalline structure of the carbon, and can enhance oxidation of carbon if oxygen is present. The techniques of the present invention significantly reduce the maximum sintering temperature required as well as the sintering time interval, as has been discussed and illustrated in previous sections. Using the methodology taught by the present disclosure thereby significantly reduced sintering temperature damage to articles of manufacture.

6.2.4 Low Temperature-Low Pressure Alloys

The low temperature-low pressure alloys disclosed in previously referenced U.S. patent application Ser. No. 08/517,814 can effectively be used in the present invention. As an example, a mix of diamond powders having grain sizes of approximately 100 and 25 microns is places in a thin refractory metal cup. A metal binding phase containing mostly zirconium powder with some trace additions of other metals to enhance the properties of the binding phase is placed in the cup. The ratio of diamond to metal powders is approximately 60:40 percent by volume. After microwave heating to a temperature of about 1,100° C., removing the cup yields the cast insert. The material can alternately be precast thereby eliminating the need for the mold cup. As an additional example, a mix of diamond powders having grain sizes of approximately 400, 100, and 25 microns is placed in a mold. A metal binding phase consisting of approximately 70% titanium, 15% copper, and 15% of material in the form of metal powders is also placed in the same container. This assembly is then microwave heated to about 1,000° C. over the course of about 40 seconds in a reducing atmosphere of nitrogen and hydrogen. The assembly is then allowed to cool in air to room temperature. When the mold is removed from the assembly, the abrasion resistant material described in this disclosure will then be bonded to the substrate as previously described. Once again, the insert can alternately be precast thereby eliminating the need for the mold.

7. Post-Manufacture Annealing of Wear Inserts

In accordance with the present disclosure, even in the finest of manufacturing processes, there are residual stresses in the finished product. Moreover, the HPHT manufacturing process results in relatively large grain sizes in the alloy making up the WC body. The body strength is suspect in that fracture may propagate more readily with large grain sizes compared to small grain sizes. This is one of the undesirable side effects of the HPHT sintering process.

Figure 12:
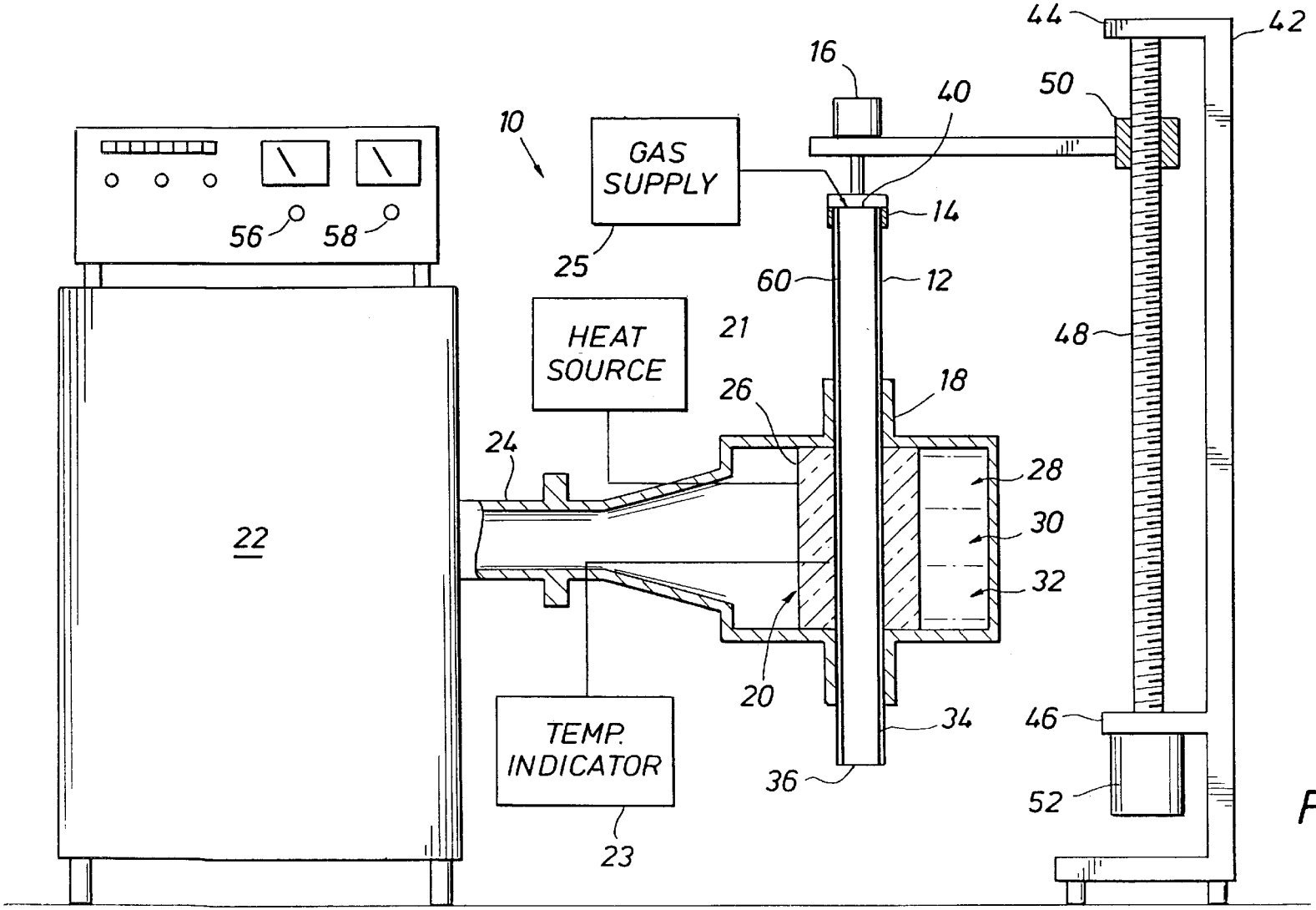
FIG. 12 is a system drawing of a microwave oven arrangement for post-manufacture annealing.

The present disclosure contemplates positioning the entire article of manufacture, such as the insert or tooth 110 shown in FIG. 2, in a microwave field for annealing. This is the stress relief step identified generally at step 32 of FIG. 1. The microwave apparatus configured for annealing is shown in FIG. 12. This configuration is a modified version of the microwave apparatus shown in FIG. 3, wherein the central area 20 of the microwave cavity has first been modified to receive a previously manufactured part. This modification is very similar to the modification of the FIG. 3 apparatus to sinter discrete parts, such as inserts, rather than to sinter particulate material, such as alumina or PDC. As an example, a manufactured tooth insert 110 as shown in FIG. 2 is placed in a receptacle similar to the mold in FIG. 7, which is transparent to microwave radiation. This rod-like receptacle is then inserted into the central area 20 of the microwave cavity, and is passed through the microwave cavity in a linear fashion if necessary. Optionally, rotation is applied by means of the motor 16 to more evenly distribute the microwave radiation for even sintering. This enables even application of microwave energy in the annealing process.

It has been found that sintered material is typically totally reflective of microwave energy at 2.45 GHz and at room temperature. Referring again to FIG. 12, an additional modification in the form of an external heat source has been added to the microwave apparatus. This external heat source 21 is used to initially elevate the temperature of the object to be annealed to a temperature at which it is at least partially absorptive. The previously described "bootstrap" heating is then initiated and continues until the annealing temperature is reached. Alternately, a lower frequency of microwave radiation can be used such that the annealed object of manufacture is at least partially absorptive at room temperature to this lower frequency radiation.

It is noted that the external heat source 21 can be employed with any embodiment of the apparatus of the invention, including the embodiment illustrated in FIG. 3. As discussed above, the external heat source can be used as a means for "preheating" the article to be sintered in order to initially increase microwave absorption, In addition, if wax-bound precast articles are to be sintered, the heat source 21 can be used to preheated and therefore "dewax" the precast immediately prior to exposure to microwave radiation. Furthermore, the external heat source 21 can be used as a means of slowing the cooling of an article after microwave sintering thereby reducing thermal shock. Still further, the external heat source can be used as a means for annealing a microwave sintered article.

It has been discovered that post-manufacture microwave heating reduces internal stress within composite parts. As a generalization, it is desirable to expose the finished product to microwave energy in the version of the apparatus shown in FIG. 12, wherein the part is first preheated by means of the external heat source 21 to become at least partially absorptive. This equipment, shown in FIG. 12, exposes the part, such as the insert 110 shown in FIG. 2, to microwave energy at a frequency of about 2.45 GHz. A continuous wave (kW) transmission is utilized for that. The microwave radiation is applied for an interval sufficient to raise the temperature resulting from heating the interior. In contrast with conventional heating sources, the heat in this instance is formed on the insert interior and radiates outwardly. As the temperature rises, the insert is heated to a temperature above about 900° C. but limited to about 1450° C. A sharp limit is not necessarily imposed at either the lower or upper end, but primarily depends on the grain boundary of the binder alloys holding the PDC and WC layers together. A short heating interval is all that is needed.

A typical prior art annealing process lasts several hours. The temperature is raised slowly and is permitted to decline rather slowly. It is not uncommon to use temperature rate of increase of about 30 or 40° per minute while ramping up and down.

The present disclosure contemplates microwave annealing in which the temperature is increased typically about 300° C. per minute, and routinely at a rate in excess of about 150° C. per minute. As will be understood, the heating cycle is relatively brief, and the device is maintained at the elevated temperature for only a short interval. For a typical single insert, the exposure to microwave energy lasts only up to about ten minutes. Heating beyond that time interval typically is not necessary and is ineffective to further enhance the properties. Furthermore, excess heating can damage components of the composite element being annealed. Heating is therefore carried out for an interval to accomplish the maximum temperature, generally in the range of about 900° C. to about 1450° C. The maximum is held for anywhere between about one and ten minutes. As a generalization, the temperature is achieved and held at a level so that the materials do not become tacky or flow and thereby deform the shape of the product. The heating is internal, i.e., heat radiates from the inside to the exterior. When heated in this fashion, part, such as the insert 110 shown in FIG. 2, is able to preserve the differences in the cobalt concentrations in the regions 114, 116 and 118. Cobalt migration does not occur. Moreover, the grain size in the cobalt alloy is kept small. That seems to enhance the strength of the composite tooth. In addition to that, microwave reduces residual stresses in the insert. Finally, components (as an example, the PDC layer 118) are not adversely physically and chemically altered by excessive heating. Heating is initiated by preheating the object by means of the external heat source 21 until the object becomes at least partially absorptive, and by then simply turning on the CW microwave transmission. Cooling down is accomplished simply by removing the heated insert 110 from the equipment and exposing it to air. This enables the device to cool at an acceptable rate.

Testing of the sintered device with x-ray inspection has shown that residual internal stress can be reduced significantly and substantially by microwave sintering. Indeed, the microwave annealing process seems to take out most residual stresses. It provides greater strength in the sense that grain size is kept relatively small. annealing by microwave assures a better bond at the braze joint 16. Last of all, it has substantial benefit in relieving stress both within the specific regions and also at or near the interfaces where the regions are brazed together.

8. Articles of Manufacture

Attention is now directed toward specific wear resistant articles of manufacture using apparatus and methods of the present invention. These articles consists of a layer of wear resistant material affixed to a support structure or "body" which is configured to perform a task. As discussed previously, the wear resistant layer can be fabricated of deposited directly upon the body of the article. Alternately, the wear resistant layer can be fabricated independently as a wear insert, and subsequently affixed to the body of the article as discussed previously. The support structure body can be fabricated from steel, silicon carbide, silicon nitride, or any suitable material which meets the required physical specifications of the support structure body. The layer of wear resistant material forms a wear resistant layer which prolongs the useful life of the article. More specifically, articles fabricated using apparatus and methods of the present invention include a variety of drills such as twist drills, roof bolt drill tips, drill bits for drilling earth formations, circuit board drills, journals of drill bits and the like. Articles further include a wear surfaces for a variety of cutting tools such as end mills, cutting inserts, a variety of milling tools, dressing tools and the like. Articles still further include wear surfaces for nozzles, valve seats, centrifugal pump liners, flow line elbows and the like in systems flowing abrasive materials such as mud. Articles also include wear surfaces for journal bearings, roller bearings and thrust bearings. In addition, article include wear resistant brake surfaces, scuff plates, extrusion dies, and forming dies. There are other articles such as saw blades that can be manufactured using methods and apparatus FIG. 13*a* shows a milling tool 200 which consist of a body 204 attached to a shank 206 which is rotated by a motor (not shown). The numeral 202 identifies a plurality of wear resistant cutting inserts 202 which are affixed to the body 204 and provide the cutting action delivered by the milling tool.

FIG. 13*b* illustrates an example of a bearing which utilizes a wear resistant surface fabricated with the present invention. A journal bearing 210 is used as a specific illustration. A wear resistant surface 216 is fabricated on a bearing body 218. The wear resistant surface contacts a rotating axle 214. The loading vector applied to the bearing 210 is illustrated with an arrow 2312.

FIG. 13*c* depicts a dressing tool 220 which comprises a shank body 222 to which a wear surface 224 is affixed. The wear surface 224 provided the dressing surface demanded by the dressing tool, and is very resistant to abrasive wear received in use.

FIG. 13*d* illustrates a grinding wheel 230 which consists if a preferably disk body 232 to which is affixed a shank 234. Affixed to the periphery of the disk 232 is a wear resistant surface 236. A motor (not shown) provides rotation of the grinding wheel 230 by rotating the shank 234. Grinding action, which is highly wear resistant to the surface 236, is therefore provided when the surface 236 contacts a work piece (not shown).

FIG. 13*e* illustrates a drill which incorporates a wear resistant surface. A twist drill 240 is used for purposes of illustration. Affixed to the drill body 244 is a helical cutting surface capped by a wear resistant surface 246. The wear resistant surface extends to the tip of the drill. Drilling action is obtained by rotating the shaft 242, wherein wear to the drill bit is minimized in that the wear surface 246 contacts the work piece (not shown).

FIG. 13*f* shows a saw blade 250 which comprises a blade body 252 and a wear resistant cutting surface 254 affixed thereto where the blade body makes primary contact with the work piece (not shown).

FIG. 13*g* depicts a cross section of a nozzle 260 through which an abrasive fluid, such as mud, flows. The nozzle consists of a body 262 which is penetrated by a passage 264 through which fluid passes. The interior of the passage 264 is coated with a wear resistant material 266. The abrasive fluid contacts only the wear resistant material 266 as it traverses the passage 264 and does, therefore, not abrade the nozzle body 262.

FIG. 13*h* shows a cross sectional view of a valve 270 comprising a valve body 274 and a valve stem assembly 278. The valve body further comprises a valve seat to which is affixed a wear resistant element 276. The valve 270 is shown open. When abrasive liquid passes through the passage 272, the wear resistant element 276 is abraded rather than the valve body 274 thereby extending the life of the valve 270.

FIG. 13*i* is a sectional view of a brake assembly 280 which comprises a brake shoe body 282 to which is affixed a wear resistant layer 284. When activated, the brake shoe contacts a rotor body 286 which is affixed to an axle 288. A second wear resistant element 284' is affixed to the face of the rotor 286 which is contacted by the brake shoe 282. Upon activation, the wear resistant element 284 contacts the wear resistant element 284' therefore prolonging significantly the life of the brake assembly.

It should be understood that FIGS. 13*a*–13*i* serve to illustrate only a portion of the articles of manufacture that utilize the apparatus and methods of the present invention.

FIG. 14 shows cutting tool inserts with regions of differing grain size and/or binder concentration. Two views of a triangular insert 290 are shown with each apex comprising an arc 291 of varying grain size and/or binder concentration. Two views are shown of a second triangular insert 292 with each apex comprising a dove-tail 293 of varying grain size and/or binding material. One view of a rectangular insert 295 is shown wherein the wear resistant material borders the entire periphery of the insert. It is again emphasized that these representative inserts can be fabricated using a mold, or can be precast prior to microwave heating thereby eliminating the need, and associated expense, for an appropriate mold.

While the foregoing is directed to the preferred embodiment, the scope thereof is determined by the claims which follow.

I claim:

1. An apparatus for making a wear resistant element, comprising:

(a) a source of microwave radiation;

(b) a central cavity connected to receive microwave radiation from said source;

(c) an elongate hollow tube to hold and position within said central cavity, wherein said tube is transparent to microwave radiation;

(d) an input of material into said tube for conveying said material into said central cavity so that said material is exposed to said microwave radiation; and (e) means for moving said material within said central cavity such that said material is sintered by uniformly exposure to said microwave radiation thereby forming said wear resistant layer.

2. The apparatus of claim 1 wherein said material is an object and wherein said means for positioning said object comprises a tube in which said object is placed.

3. The apparatus of claim 2 wherein said moving means comprising a drive mechanism which linearly conveys said tube in which said object is fixed through said central cavity.

4. The apparatus of claim 2 wherein said moving means comprising a rotational drive mechanism which rotates said tube about the axis of said tube within said central cavity.

5. The apparatus of claim 1 wherein said material is particulate material, and said tube which passes through said cavity and wherein said tube comprises an upper end and a lower end, and said means for moving said particulate material through said central cavity comprises:

(a) an inlet at said upper end of said tube and into which said particulate material is deposited;

(b) a regulatory valve at said lower end if said tube;

(c) wherein the position of said valve is set to regulate the flow of said particulate material through said tube.

6. The apparatus of claim 1 further comprising a gas supply which cooperates with said means for moving material within said central cavity thereby controlling the atmosphere of said material within said central cavity.

7. The apparatus of claim 1 further comprising an external heat source which cooperates with said means for moving material within said central cavity thereby allowing the ambient temperature of said material:

(a) to be elevated prior to irradiation with microwave radiation;

(b) to be elevated prior to irradiation with microwave radiation as a means for dewaxing a precast mold of said material;

(c) to be lowered at a controlled rate after irradiation with microwave radiation thereby minimizing thermal shock; or (d) to be raised and lowered at a controlled rate as a means of annealing after irradiation with microwave radiation.

8. The apparatus of claim 1 further comprising a temperature indicator which cooperates with said means for moving material within said cavity thereby allowing the temperature of said material to be monitored within said central cavity.

9. The apparatus of claim 1 further comprising an insulative sleeve which cooperates with said means for moving material within said central cavity thereby maximizing heat retention within said material.

10. The apparatus of claim 1 further comprising a power control which cooperates with said source of microwave radiation, wherein said source of microwave radiation produces at least 10 Watts per cubic inch of heated space within said central cavity.

11. The apparatus of claim 1 wherein said source of microwave radiation produces substantially 30 Watts per cubic inch of heated space within said central cavity.

12. The apparatus of claim 1 further comprising a timer which cooperates with said source of microwave radiation thereby allowing said material to be irradiated with microwave radiation for a controlled time interval.

13. The apparatus of claim 1 wherein the frequency of radiation emitted from said source of microwave radiation is about 2.45 GHz.

14. The apparatus of claim 1 wherein the frequency of radiation emitted from said source of microwave radiation is within the range of 1.5 GHz to 4.0 GHz.

15. An apparatus for fabricating an article comprising a support structure and a wear resistant layer affixed thereto, said apparatus comprising:

(a) a source of microwave radiation;

(b) a central cavity into which microwave radiation is directed from said source;

(c) non pressurized means for positioning material from which said wear resistant layer is fabricated into said central cavity, wherein said means is transparent to microwave radiation;

(d) means for linearly conveying said material within said central cavity such that said material is sintered by uniformly exposure to said microwave radiation thereby forming said wear resistant layer; and (e) means for rotating said material within said central cavity such that said material is sintered by uniformly exposure to said microwave radiation thereby forming said wear resistant layer.

16. The apparatus of claim 15 wherein said support structure comprises steel, silicon carbide, silicon nitride, or a high temperature ferrous alloy.

17. The apparatus of claim 15 wherein said wear resistant layer is fabricated directly upon said support structure.

18. The apparatus of claim 15 wherein said wear resistant layer is fabricated and subsequently affixed to said support structure.

19. The apparatus of claim 15 wherein said support structure comprises a mill.

20. The apparatus of claim 15 wherein said support structure comprises a bearing.

21. The apparatus of claim 15 wherein said support structure comprises a finishing tool.

22. The apparatus of claim 15 wherein said support structure comprises a drill.

23. The apparatus of claim 15 wherein said support structure comprises a grinder.

24. The apparatus of claim 15 wherein said support structure comprises a saw blade.

25. The apparatus of claim 15 wherein said support structure comprises a nozzle.

26. The apparatus of claim 15 wherein said support structure comprises a valve.

27. The apparatus of claim 15 wherein said support structure comprises a brake assembly.

28. An apparatus for making a wear resistant structure, the apparatus comprising:

(a) a source of microwave radiation;

(b) a central cavity into which microwave radiation is directed from said source;

(c) non pressurized means for positioning said structure within said central cavity, wherein said means is transparent to microwave radiation; and (d) means for conveying said structure through and rotating said structure within said central cavity such that (i) said structure is exposed to said microwave radiation, (ii) said structure absorbs said microwave radiation, and (iii) the temperature of said structure is elevated by said absorption to an annealing temperature thereby forming said wear resistant structure.

29. The apparatus of claim 28 wherein said structure is conveyed within said microwave radiation such that said microwave radiation is uniformly absorbed by all regions of said structure.

* * * * *

UNITED STATES PATENT AND TRADEMARK OFFICE
Certificate

Patent No. 6,011,248

Patented: January 4, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of the patent is: Dinesh Agrawal, 156 Aberdeen Lane, State College, PA 16801; Roy Rustum, 528 S. Pugh St., State College, PA 16801; Jiping Cheng, 2297 Quail Run Road, State College, PA 16801; Paul Gigl, 246 Whitehill St., Lemont, PA 16851-1113.

Signed and Sealed this Thirteenth Day of March, 2001.

TERESA J. WALBERG
*Supervisory Patent Examiner*
Art Unit 3742